United States Patent [19]

Griffee et al.

[11] 3,952,310

[45] Apr. 20, 1976

[54] CROSSED DIPOLE AND SLOT ANTENNA IN PYRAMID FORM

[75] Inventors: Leslie V. Griffee, Dallas; Mardis V. Anderson, Richardson, both of Tex.

[73] Assignee: Rockwell International Corporation, El Segundo, Calif.

[22] Filed: Feb. 20, 1975

[21] Appl. No.: 551,472

[52] U.S. Cl. ..... 343/730; 343/770; 343/797

[51] Int. Cl.[2] ..... H01Q 21/26

[58] Field of Search ..... 343/727, 797, 730, 770

[56] References Cited

UNITED STATES PATENTS 3,546,705 12/1970 Lemson ..... 343/797

3,811,127 5/1974 Griffee et al. ..... 343/797

*Primary Examiner*—Eli Lieberman

*Attorney, Agent, or Firm*—Bruce C. Lutz; Robert J. Crawford

[57] ABSTRACT

Crossed dipole antenna apparatus configured so that the ends of adjacent dipoles are connected together to form a version of folded dipole antennas wherein there are slot antennas between adjacent dipole antennas. The combination slot and dipole antennas provide relatively broadband usable frequency range with acceptable radiation patterns.

3 Claims, 5 Drawing Figures

CROSSED DIPOLE AND SLOT ANTENNA IN PYRAMID FORM

THE INVENTION

The present invention is generally concerned with electronics and more specifically concerned with antennas. Even more specifically, it is related to crossed dipole antennas.

While there is prior art illustrating the combination of dipole antennas and slot antennas, it is believed that the present inventive concept is the first instance of crossed dipole antennas combined with a crossed slot antenna configuration in a compact, light-weight and yet strong antenna configuration.

It is known in the art that dipole antennas have a low impedance comprising primarily capacitive reactance. Slot antennas, on the other hand, have a high impedance comprising primarily inductive reactance. By the design of the present invention wherein the ends of adjacent cross dipole antennas are connected together to form intermediate slot antennas, a resulting complementary antenna design is produced whereby the total antenna impedance is nearly constant over a wide frequency band and has a total impedance intermediate that of a pure dipole or pure slot design. The low effective reactance is advantageous in that with impedance remaining nearly resistive over a wide range of frequencies the antenna is usable over a much larger frequency bandwidth for a given transmitter and specified output power than previous designs.

Another disadvantage of plain crossed dipole antennas is that there is a very high (as much as 10 to 1) voltage increase from the center of the dipole to the ends of the antenna elements thereby resulting in corona discharge for high power antennas. The corona discharge results in "eating of" or otherwise disintegrating the ends of the antenna elements. The effect of the "folded" dipole antenna design utilized in the present invention is a much lower voltage increase (in the neighborhood of 3 to 1) from the center of the antenna to the extremities thereby allowing much higher power inputs before corona discharge occurs. Thus, much greater range is obtainable with the present invention than prior art dipole antennas.

As will be realized, the present invention may be used either as illustrated or in an array to provide directional capability. However, arrays per se are old in the art and it would be well within the skill of a person in the art to arrange the present inventive concept in an array of general prior art design.

It is, therefore, an object of the present invention to provide an antenna having increased usable frequency bandwidth.

A further object of the present invention is to provide an antenna which can profitably use very high power levels of signal transmission without disintegration of the ends due to corona discharge.

These and other objects and advantages of the present invention will be ascertained from reading of the specification and appended claims along with the drawings wherein:

Figure 1:
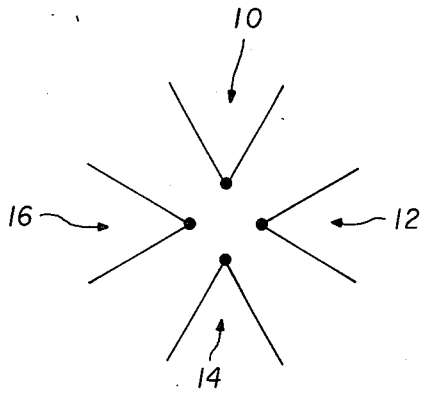
FIG. 1 PRIOR ART
FIG. 1 is a schematic illustration of prior art dipole antenna design.

In FIG. 1, four dipole sections 10, 12, 14 and 16 are illustrated. The dipole sections 10 and 14 provide one dipole antenna with the sections 12 and 16 providing another dipole antenna. The use of the two orthogonally situated dipole antennas in a single antenna combination is called "crossed dipole" antenna.

Figure 2:
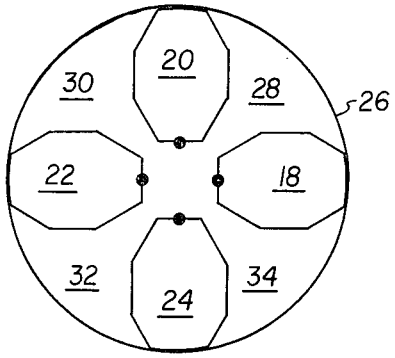
FIG. 2 is a simplified representation of a preliminary embodiment of the present invention.

In FIG. 2, an inventive variation of FIG. 1 was provided to produce a first embodiment of the present invention. As illustrated, sheets of metal 18, 20, 22 and 24 are connected to signal input leads shown as dots on the central portion thereof. A ring 26 extends to the extremity of each of the metal portions 18 – 24. The ring 26 effectively closes the space between adjacent metal sheets 18 – 24 to form slot antennas which have been labeled as 28, 30, 32 and 34.

In a manner similar to that of FIG. 1, the metal plates 18 and 22 form one dipole antenna while the plates 20 and 24 form another dipole antenna. The four plates together form a crossed dipole configuration and the shorting bar comprising the ring 26 produces an effect of folded dipole antennas of a crossed dipole configuration. It is believed that folded crossed dipole antennas wherein the folded elements are connected together is an inventive concept in and of itself. Since the configuration illustrated forms slot antennas as shown for the areas 28 – 34, the antenna provides the wide frequency bandwidth capabilities as mentioned in the introductory portion of this patent disclosure. As will be realized by those skilled in the art, the apertures or slots 28 and 32 form one slot antenna while the apertures or slots 30 and 34 form a second (crossed) slot antenna. Thus, the configuration of FIG. 2 actually discloses four separate antennas (i.e., two dipole and two slot antennas).

Figure 3:
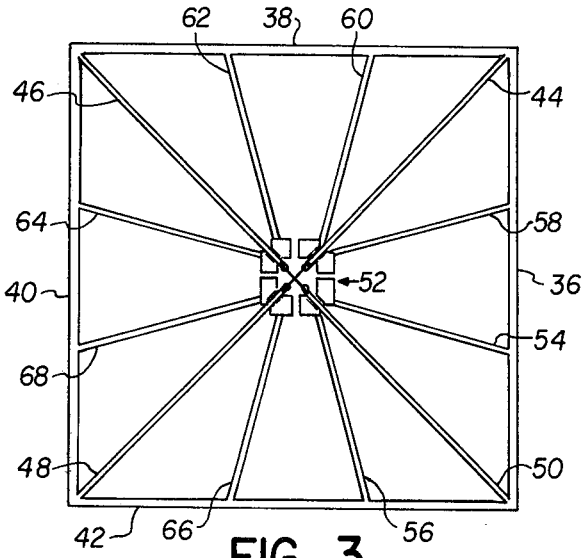
FIG. 3 is a plan view of a preferred embodiment of the present invention.
Figure 4:
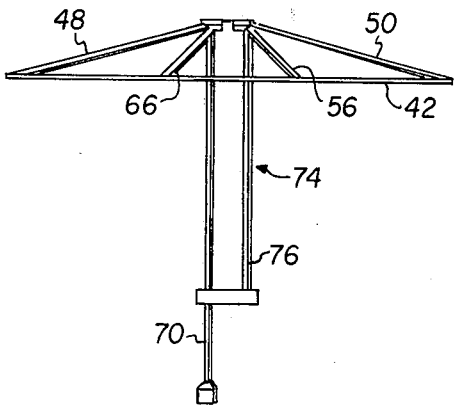
FIG. 4 is an elevation view of the embodiment of FIG. 3.
Figure 5:
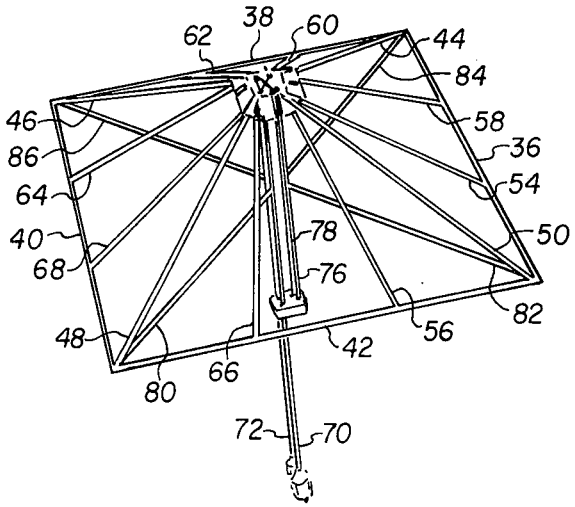
FIG. 5 is a pictorial view of the preferred embodiment of the present invention as presently illustrated in FIGS. 3 and 4.

In FIGS. 3, 4 and 5, all the elements which are common are given the same number designator. As illustrated, the preferred embodiment of the antenna utilizes four conductors or conduits 36, 38, 40 and 42 to enclose the periphery of the antenna and effectively form the base or outline of a base of a pyramid of the rectangular style (sometimes defined as a regular pyramid). Four conduits 44, 46, 48 and 50 extend from the corners or vertices of the base to a vertice at the point of the pyramid or antenna and converge at a signal transmission means generally designated as 52. The elements 44 – 50 form central structural members, supports, links or axis in each of four dipole antenna sections. The dipole antenna section utilizing support 50 has additional conductive elements 54 and 56 defining the outer edge thereof. The dipole element utilizing support 44 has conductors or conduits 58 and 60 defining the outer edges of this dipole element. Conductors or conduits 62 and 64 define the outer edges of the dipole element utilizing strut 46 and operate in conjunction with the dipole element utilizing support 50. The remaining dipole element is defined by conductive conduits 66 and 68. Thus, the conduits 54 and 58 in conjunction with a portion of conduit 36 form a first slot antenna section with conduits 64 and 66 and a portion of conduit 40 forming its complementary slot antenna section. As will be realized, conduits 60 and 62 in conjunction with a portion of conduit 38 form one section of the remaining slot antenna while conduits 56 and 66 in conjunction with a portion of conduit 42 form the remaining complementary part of the last mentioned slot antenna section. Signals are transmitted to and from the antenna via conduits 70 and 72. As illustrated, a signal being supplied through signal transmission means 70 is applied to the dipole antenna utilizing element 48 and there is a crossover in the vertex section 54 so as to also supply this signal to the dipole section utilizing element 44. The signal transmission means 72 is used to supply signals to the dipole element incorporating structural member 46 and using the crossover lead in section 52 also provides signals to the dipole element utilizing structural member 50. As further illustrated, the signal transmission means 70 and 72 form a portion of a central support section 74 having additional elements 76 and 78 for developing the proper impedances in the complementary sections of the individual dipole antennas. The feeding of signals to the dipole antennas simultaneously supplies signals to the slot antenna through signal coupling by adjacent conductors.

It will be further noted that the antenna of the preferred embodiment has additional structural members 80, 82, 84 and 86. These structural members extend from the vertices of the base of the pyramid to the central support section 74 to provide additional rigidity. As will be noted, the antenna is comprised entirely of triangular elements and the triangular formation is the most rigid structure known. Thus, the antenna utilizes the lightweight of an "outline antenna" configuration for defining the dipole antenna elements and the slot antenna elements, combines the best features of slot and dipole antennas to provide a very broadband antenna configuration and through the use of triangularly shaped sections produces an extremely rigid antenna for its weight.

Although not illustrated, this type of antenna is often and normally used in front of a reflector. The impedance of a crossed dipole in front of a reflector is normally low (30 to 70 ohms) at resonance. At frequencies below resonance, it has capacitive reactance and at frequencies above resonance it has inductive reactance. The impedance of a slot antenna is high (several hundred ohms) at resonance. At frequencies below resonance it has inductive reactance and at frequencies above resonance it has capacitive reactance.

When the two configurations are combined as in the present inventive concept, the reactive components partially cancel. The impedance then is predominately resistive over a quite large frequency band. The resistance is fairly constant over this band and has a value of about 200 ohsm. The antenna therefore has a low inherent VSWR although at an impedance not normally used. This impedance can be transformed to desired values by methods generally known to those skilled in the art.

As illustrated, the two dipole antennas formed are orthogonal to each other resulting in isolation of about 30 dB between the two. This permits several possible modes of operation. Each of the antennas may be used separately to provide two communication circuits or they may be used as a pair to provide any polarization. When used to provide circular polarization, a 90° hybrid is necessary in the feed lines. These hybrids are generally known to those skilled in the art and are commercially available. The hybrid excites the two parts of the antenna with a ninety-degree phase difference resulting in circular polarization. Power reflected from the antenna is dissipated in the termination on the hybrid and very little reflected power is returned to the transmitter. The low inherent VSWR of the subject antenna is useful in keeping the power in the hybrid termination to a low value.

As indicated previously, the structural elements forming the antenna of the preferred embodiment are conduits. Conduits are most desirable in that there is no concentration of sharp edges wherein the electrical field may be concentrated. For low power levels, the antenna could be made of angle iron or other structural elements. If weight of the antenna is of no concern, the structural elements may be solid. However, it has been ascertained that if the elements are hollow, the antenna can be made very rigid, yet lightweight and it has further been determined that the larger the radius of the conductive elements, the more power the antenna can handle before corona discharge occurs.

While the relative placement and spacing of the antenna elements are illustrated for a given antenna use, other conductive element layouts will be apparent to those skilled in the art for other applications of this inventive concept to specific requirements. These requirements would include, but not be limited to, the type of polarization or separate dipole antenna usage as discussed above.

While various terminology has been used for the elements of the antenna such as conductors, it is to be realized that the novel feature of the present invention is the combination of crossed dipole antennas in conjunction with complementary slot antennas configured between the crossed dipole antennas to provide a broadband antenna having a much higher power capability than previous antennas for a given amount of corona discharge. While the preferred embodiment utilizes hollow structural elements, the inventive concept includes the use of solid flat pieces of metal such as illustrated schematically in FIG. 2 or the use of solid elements rather than hollow elements as defined. Thus, the antenna may be fabricated from any type of conductive material of any configuration as long as a combination of dipole and slot antennas is defined in accordance with the scope of the appended claims.

What is claimed is:

1. Apparatus of the class described comprising, in combination:

first dipole antenna means having a first axis;

second dipole antenna means having a second axis mounted orthogonal the axis of said first dipole antenna means;

means connecting the ends of said first and said second dipole antennas together to form slot antenna means intermediate said dipole antenna, in the general shape of a regular pyramid with the ends of each dipole antenna means defining opposing vertices of the base of the pyramid; and means supplying power to said dipole antennas at the remaining vertice, which remaining vertice is removed from the base of the pyramid.

2. Antenna means comprising, in combination:

first structural element means forming a square base means;

central support means including signal transmission means;

second structural element means structurally connecting a point on said central support means spaced from one end thereof to the vertices of said square base means;

third structural element means connecting said signal transmission means at said one end of said central support means to points adjacent opposing first and second vertices of said square base means; and fourth structural element means connecting said signal transmission means at said one end of said central support means to points adjacent opposing third and fourth vertices of said base means, said third and fourth structural element means defining edges of crossed dipole antennas.

3. Crossed dipole antenna means comprising, in combination:

support means defining a centrally located axis;

signal conductive means forming the outline of a regular pyramid;

means connecting said support means to and maintaining it equidistant from each of the vertices of the base of said pyramid and to the remaining vertice of said pyramid; and signal transmission means coupled to said conduit means, said signal conductive means forming crossed dipole antenna means with slot antenna means located on each triangular shaped face of said pyramid.

* * * * *